US005659965A

United States Patent [19]

Thibodeau et al.

[11] Patent Number: 5,659,965

[45] Date of Patent: Aug. 26, 1997

[54] COMBINATION OPTICAL AND IRON SIGHT SYSTEM FOR ROCKET LAUNCHER

[75] Inventors: Robert Thibodeau, Chletenham, Md.; Michael Canaday, King George, Va.

[73] Assignee: The United States of America as represented by the Secretary of the Navy, Washington, D.C.

[21] Appl. No.: 514,885

[22] Filed: Aug. 14, 1995

[51] Int. Cl.[6] ..... F41G 1/16; F41G 1/393

[52] U.S. Cl. ..... 33/261; 33/247; 33/252; 42/100

[58] Field of Search ..... 33/233, 234, 248, 33/249, 250, 251, 252, 261, 247; 250/553, 333; 89/1.7, 1.816; 42/100

[56] References Cited

U.S. PATENT DOCUMENTS

| | | | |
|---|---|---|---|
| 2,664,635 | 1/1954 | Brandt . | |
| 2,814,118 | 11/1957 | Evans et al. . | |
| 3,961,423 | 6/1976 | Hrebar | 33/258 |
| 3,979,848 | 9/1976 | Ackerman, Jr. | 33/248 |
| 3,984,916 | 10/1976 | Newcomb et al. | 33/251 |
| 4,092,793 | 6/1978 | Ricks | 33/249 |
| 4,461,087 | 7/1984 | Norman | 33/261 |
| 4,689,910 | 9/1987 | Choate et al. | 42/100 |
| 4,841,659 | 6/1989 | Williams | 33/261 |
| 4,934,085 | 6/1990 | Lough | 33/250 |

*Primary Examiner*—G. Bradley Bennett
*Attorney, Agent, or Firm*—James B. Bechtel, Esq.

[57] ABSTRACT

A combination optical and iron sight system for a rocket launcher is provided. The combination sight system has a mounting bracket for attachment to a spotter rifle of a typical rocket launcher. A sight mounting bracket having an elevation adjustment and a windage adjustment is adapted for attachment to the spotter rifle mounting bracket. The adjustable sight mounting bracket has a mounting structure for an iron sight and a mounting bracket structure for an optical sight. Each sight, the optical sight and iron sights may be adjusted individually with respect to the adjustable bracket. Thereafter, adjustments to both sights can be made simultaneously by adjustment of the bracket itself in both windage and elevation.

9 Claims, 4 Drawing Sheets

COMBINATION OPTICAL AND IRON SIGHT SYSTEM FOR ROCKET LAUNCHER

ORIGIN OF THE INVENTION

The invention described herein was made in the performance of official duties by an employee of the Department of the Navy and may be manufactured, used, licensed by or for the Government for any governmental purpose without payment of any royalties thereon.

1. Field of the Invention

The present invention relates generally to gun sight technology and more particularly to combination sights for rocket launchers and recoilless rifles.

2. Background of the Invention

Optical sights for small armed rocket launchers and recoiler rifles are well known in the art. Previous sighting devices for small arms, rocket launchers or recoilless rifles having both iron sights and optical sights typically had iron sights fixed to either the optical sight casing or to a spotter rifle. A representative prior art sight has a notch and blade type sight molded to the optical sight's casing or mounted directly on the weapon itself. There are several disadvantages to both of these systems. In the former system, the iron sight cannot be boresighted or aligned with the weapon but merely provides a line of sight of the optical scope. Mounted in this fashion, with the notch and blade attached to the optical scope, the usefulness of the sight is restricted to that of a pointer for the optical sight as opposed to a useful sight for the weapon. In the latter configuration, where the iron sight and optical are both separately mounted, there is no corresponding range or windage adjustment when the optical sight is adjusted from target to target. Because of this, both sights must be realigned every time there is a change in target range or windage. What is needed is a combination sight system wherein an optical scope sight can be adjusted for a particular range and an iron sight, blade and notch assembly can likewise be adjusted for a particular range and thereafter the entire system may be realigned for a new range or windage with a single adjustment which moves both the iron sight and the optical scope.

SUMMARY OF THE INVENTION

Accordingly, it is an object of the invention to provide a combination optical and iron sight system for rocket launchers or other similar type weapons having a single adjustment to alter the elevation of both sights and a single adjustment to alter the windage for both sights.

It is another object of the invention to provide a combination optical and iron sight system for rocket launchers having a separate elevation and windage adjustment for the iron sight.

It is yet another object of the invention to provide a combination optical and iron sight system for rocket launcher having a separate adjustment for the optical scope both in windage and elevation.

In accordance with these and other objects, the invention provides an iron sight which can be adjusted for the boresight of the weapon. The iron sight system comprises a post front sight adjustable in elevation for boresighting and an aperture rear or peep sight adjustable in azimuth for boresighting. The iron sight elements can be adjusted by means of screws to be in alignment with the bore of the weapon. The front and rear elements of the iron sight fold down so that when being transported they are protected. Additionally, the sight comprises an adjustable mounting bracket to hold the iron sight assembly and also to hold the optical scope. The adjustable bracket has both windage and elevation adjustments so that the bracket itself may be aligned with the boresight of the weapon. Further, the invention comprises an optical tube which may have adjustments for both windage and elevation so that individual adjustments may be made with respect to the bracket. Alternately, a non-adjustable optical scope may be used, the scope being boresighted by means of the adjustable bracket only.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
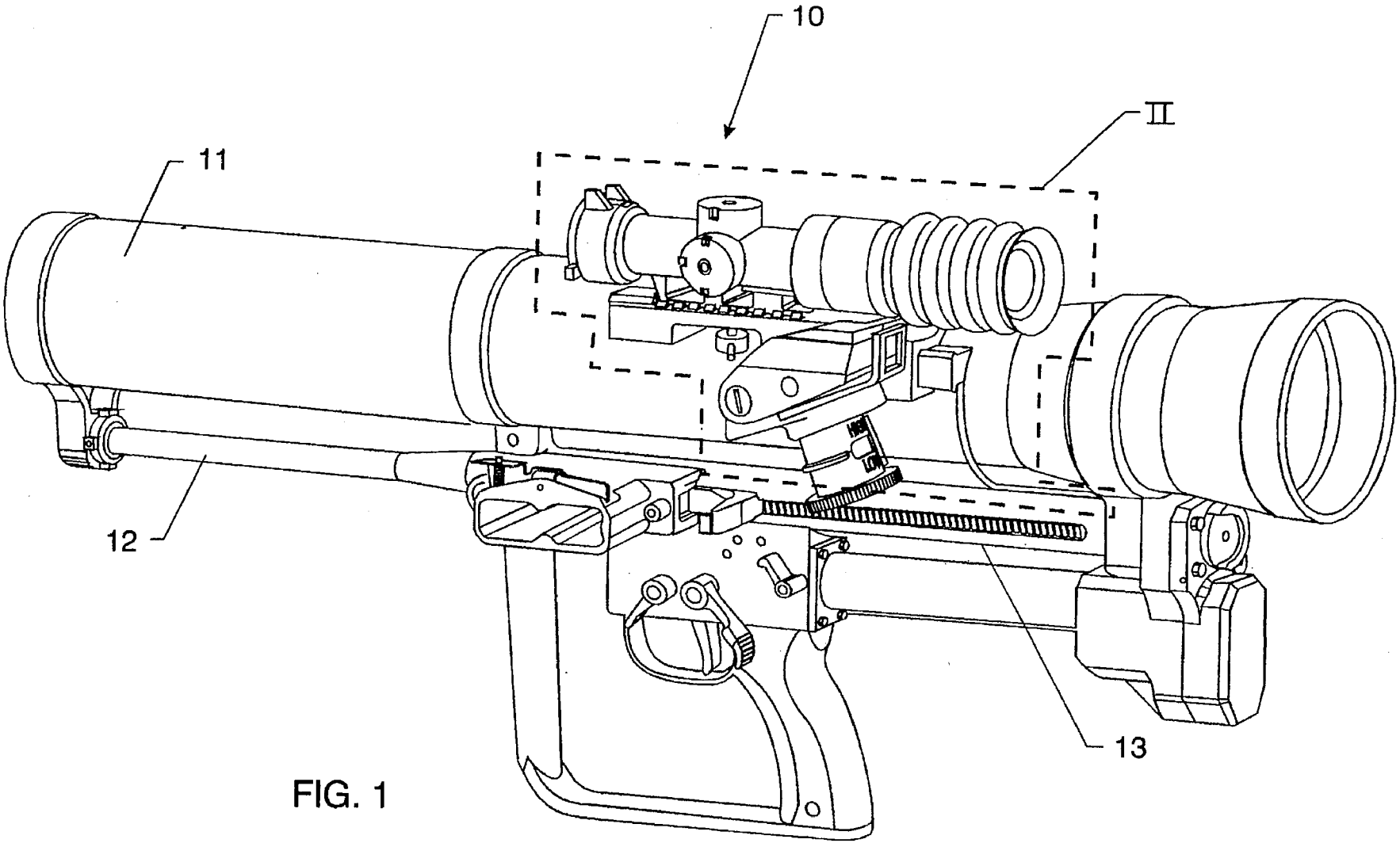
FIG. 1 is an overall view of the combination optical and iron sight system of the present invention shown mounted on a typical rocket launcher/spotter rifle assembly.

Referring now to FIG. 1, the overall combination optical and iron sight system of the present invention, designated generally by the reference numeral 10, is shown attached to a typical rocket launcher. The rocket launcher tube 11 is shown along with the spotter rifle 12 for reference. The sight system 10 is mounted on the receiver 13 of the spotter rifle 12 and is enclosed in the dotted box designated II, as shown further in FIG. 2.

Figure 2:
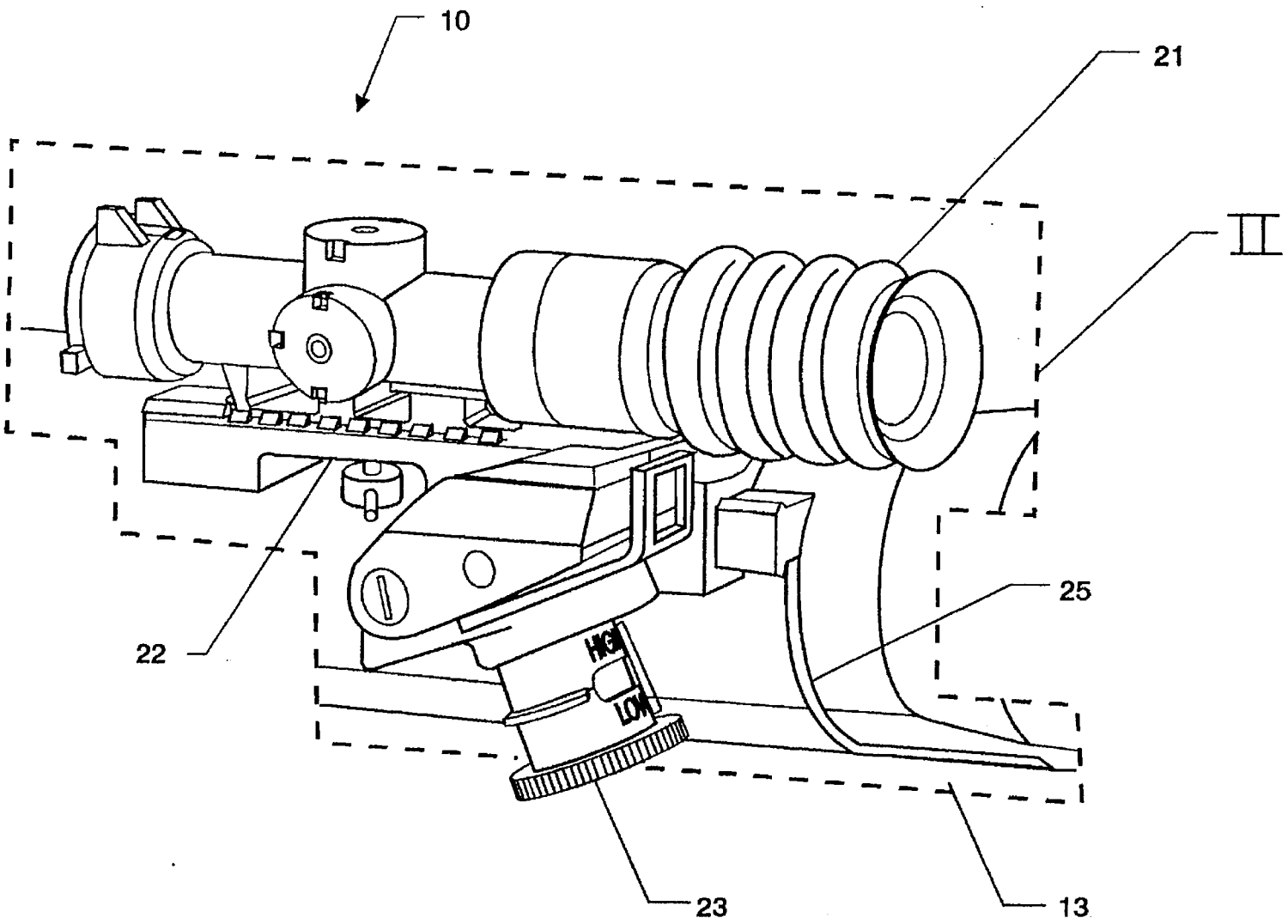
FIG. 2 is an overall view of the combination sight system of the present invention showing the major components thereof.

Referring now to FIG. 2, major components of the combination optical and iron sight system 10 are shown. The optical scope 21 is attached to the adjustable sight mounting bracket 22 which, in turn, is attached to a rifle bracket mount 25 which attaches to the spotter rifle receiver 13. As the mounting for the optical scope is itself adjustable, the scope may be either adjustable or non-adjustable. The rifle bracket mount 25 is a cylindrical section which fits around a rocket tube. The elevation adjustment is achieved by adjustment knob 23. Not shown in this figure are the adjustable iron sights which are located on the right side of the optical scope 21, behind the scope in this view.

Figure 3:
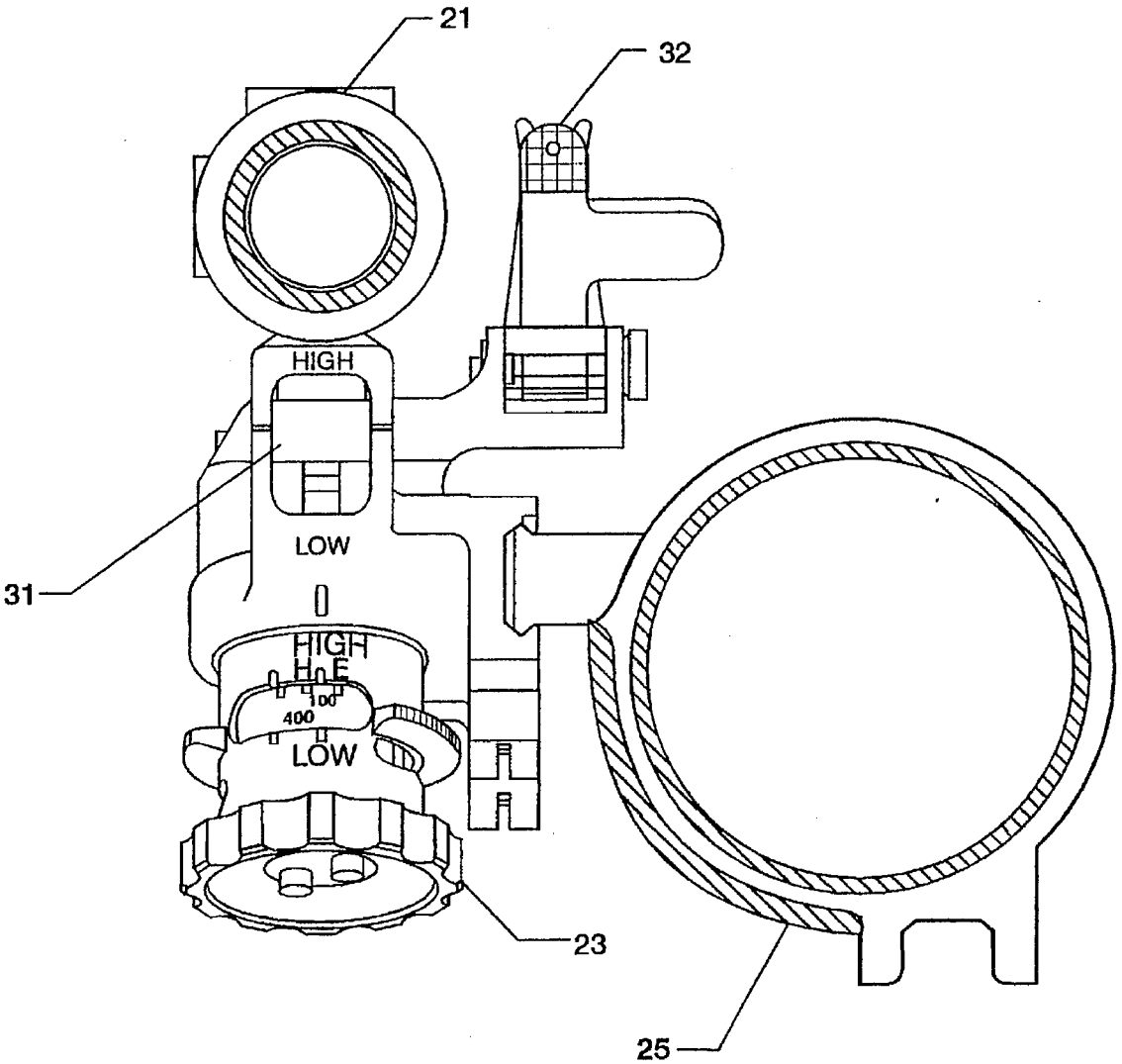
FIG. 3 is a rear view of the combination sight system of the present invention.

A rear portion of the iron sight may be seen more clearly in FIG. 3 wherein the peep sight 32 is shown on the right side of optical sight 21. Alternatively, a rear notch sight may be used in place of peep sight 32. Mounting bracket 25 and elevation adjustment 23 are shown for reference. Also shown is the elevation adjustment window 31 which shows the general adjustment for range.

Figure 4:
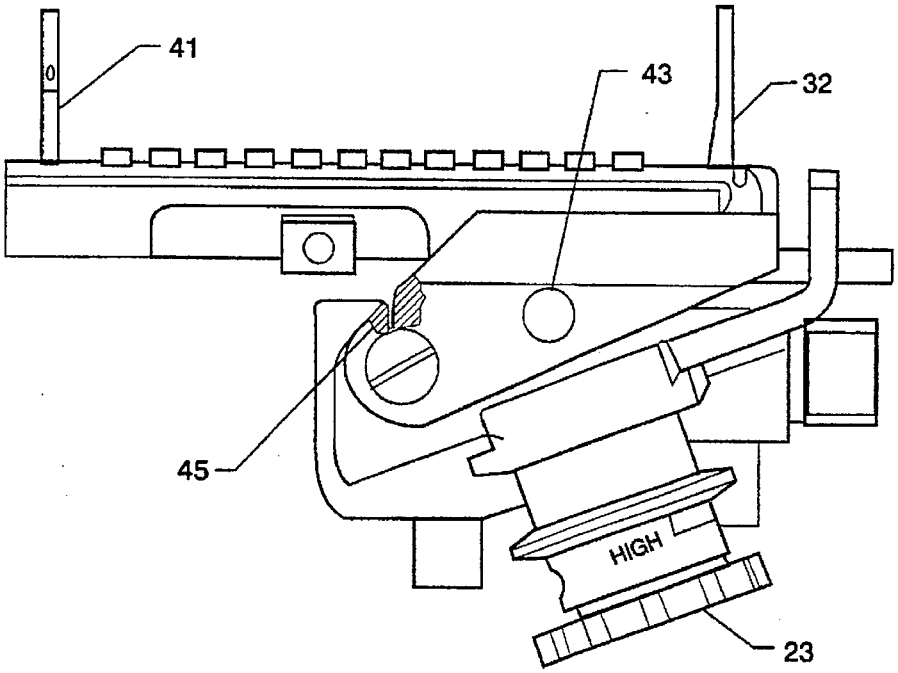
FIG. 4 is a side view of the adjustable sight mounting bracket.
Figure 5:
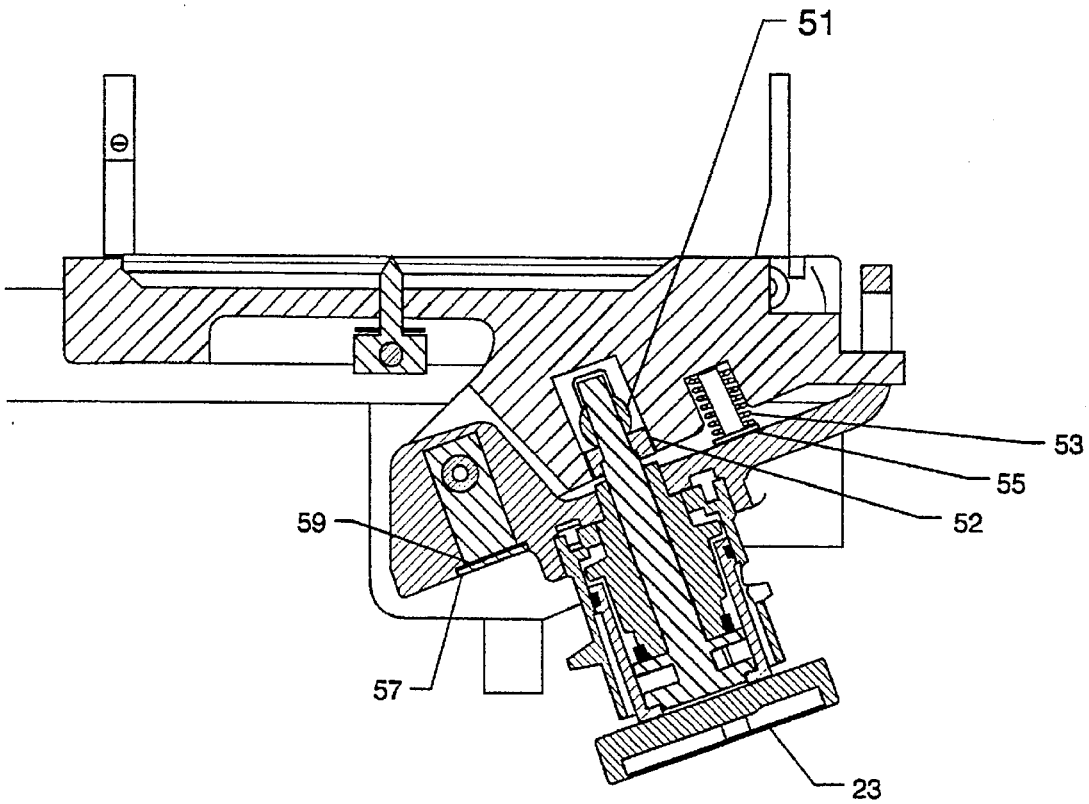
FIG. 5 is a cross-sectional view of the adjustable sight mounting bracket of the present invention.

Operation of the mounting bracket for both the optical scope and the iron sights may be seen more clearly in FIGS. 4 and 5. In FIG. 4, the scope 21 has been removed and the iron sight can be seen: peep sight 32 and front post 41. Both the peep sight 32 and the front post 41 can be folded down into a stowed position so as to avoid damage during transport. The windage adjustment screw 45 adjusts the left and right angular positioning of the bracket and therefore adjusts both the optical and fixed sights. Likewise, the elevation adjustment 23 adjusts both the iron sights and the optical sight mounted on this bracket. A pin 43 accepts the load of the elevation adjustment 23 and pivots the entire bracket around screw 45.

Referring now to FIG. 5, a cross-section of the bracket assembly as shown in FIG. 4 is depicted. The bracket assembly comprises a trunion pin 51, a tubular seal 52 sealing the mechanism against outside contaminants, a larger helical compression spring 53, and a smaller helical compression spring 55. Elevation adjustment knob 23 is shown again for reference. The windage adjustment comprises a steel shim 59 and a spring washer 57.

The features and advantages of the invention are numerous. The invention allows the gunner (of a weapon to which this invention is attached) to quickly switch from an iron sight with a large field of view to a high-powered optical sight with a confined field of view without loss of weapon aim. It also allows the gunner to switch instantly to the iron sight in the event of optical sight failure such as sight fogging. Further, the dual mounting structure of the adjustable sight mounting bracket provides a first and second mounting structure which allow both the iron sight and the optical sight to be boresighted at a particular range and thereafter to have a single adjustment point to adjust both the optical sight and the iron sight for either elevation or windage. Additionally, the adjustable sight mounting bracket allows the use of a less expensive non-adjustable optical scope as the adjustable bracket itself can provide alignment of the scope. Thereafter, the iron sights can be aligned using the iron sight adjustments. Further adjustment for both sights can then be made as described for target range or windage changes.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A combination optical and iron sight system assembly for a rocket launcher comprising:

a rifle bracket for attachment to a spotter rifle;

an adjustable sight mounting bracket, having single adjustments to adjust both optical and iron sights, attached to said rifle bracket mount;

an optical sight attached to said sight mounting bracket; and an adjustable iron sight attached to said sight mounting bracket.

2. A combination optical and iron sight system assembly for a rocket launcher as in claim 1 wherein said rifle bracket comprises a cylindrical section bracket adapted for attachment to a spotter rifle receiver.

3. A combination optical and iron sight system assembly for a rocket launcher as in claim 1 wherein said adjustable sight mounting bracket comprises a bracket having a first mounting structure and a second mounting structure.

4. A combination optical and iron sight system assembly for a rocket launcher as in claim 3 wherein said adjustable sight mounting bracket further comprises an elevation adjustment and a windage adjustment, each of these adjustments moving both the first and second mounting structures.

5. A combination optical and iron sight system assembly for a rocket launcher as in claim 4 wherein said elevation adjustment includes an elevation adjustment window.

6. A combination optical and iron sight system assembly for a rocket launcher as in claim 1 wherein said optical sight comprises a non-adjustable optical scope.

7. A combination optical and iron sight system assembly for a rocket launcher as in claim 1 wherein said optical sight comprises an adjustable optical scope.

8. A combination optical and iron sight system assembly for a rocket launcher as in claim 1 wherein said adjustable iron sight comprises a rear peep sight and front post combination.

9. A combination optical and iron sight system assembly for a rocket launcher as in claim 1 wherein said adjustable iron sight comprises a foldable sight having a folding front post and a folding rear peep sight.

* * * * *